US006116865A

United States Patent [19]

Fischer et al.

[11] Patent Number: 6,116,865

[45] Date of Patent: Sep. 12, 2000

[54] WATER BOX FOR A THICK MATTER PISTON PUMP HAVING TWO SIDES OF ACCESS

[75] Inventors: Gerald Fischer, Stuttgart; Gotthardt Unger, Grossbettlingen, both of Germany

[73] Assignee: Putzmeister Aktiengesellschaft, Germany

[21] Appl. No.: 09/319,125

[22] PCT Filed: Jun. 6, 1998

[86] PCT No.: PCT/EP98/03403

§ 371 Date: Jun. 1, 1999

§ 102(e) Date: Jun. 1, 1999

[87] PCT Pub. No.: WO99/00599

PCT Pub. Date: Jan. 7, 1999

[30] Foreign Application Priority Data

Jun. 26, 1997 [DE] Germany ..... 197 27 103

[51] Int. Cl.[7] ..... F04B 17/00; F04B 15/02

[52] U.S. Cl. ..... 417/403; 417/900; 92/128

[58] Field of Search ..... 417/403, 900, 417/340, 342, 516; 92/128

[56] References Cited

U.S. PATENT DOCUMENTS

| | | | |
|---|---|---|---|
| 3,146,721 | 9/1964 | Schwing | 417/403 |
| 3,682,575 | 8/1972 | Guddal et al. | 417/517 |
| 4,258,612 | 3/1981 | Kuhlmann | 92/128 |
| 4,437,817 | 3/1984 | Metzelder | 417/507 |
| 4,563,135 | 1/1986 | Riker | 417/517 |
| 4,569,642 | 2/1986 | Dwyer | 417/516 |
| 4,893,992 | 1/1990 | Schlecht | 417/238 |
| 5,180,294 | 1/1993 | Watchorn | 417/516 |
| 5,332,366 | 7/1994 | Anderson | 417/63 |

*Primary Examiner*—Charles G. Freay
*Assistant Examiner*—Robert Z. Evora
*Attorney, Agent, or Firm*—Pendorf & Cutliff

[57] ABSTRACT

The invention relates to a piston pump for thick matter such as concrete, sewage sludge, excavated tunnel material and similar. The inventive piston pump has at least one hydraulically operated pump cylinder (10, 12). The pump piston (30) of said pump cylinder (10, 12) is connected to the piston (38) of a hydraulic drive cylinder (26, 28) by a common piston rod (34). A water box (42) is situated between the pump cylinders (10, 12) and the drive cylinders (26, 28), the piston rod (34) passing through said water box (42) for cleaning purposes. Said water box (42) has an assembly opening (44) at the top end, said opening being accessible from above, and a closeable water outlet nozzle (66) located at the bottom end. The water box also has an assembly opening located at the bottom end for easier assembly. Said bottom-end assembly opening (54) can be closed in such a way that it is liquid-tight by means of a removable base plate (52).

16 Claims, 2 Drawing Sheets

WATER BOX FOR A THICK MATTER PISTON PUMP HAVING TWO SIDES OF ACCESS

BACKGROUND OF THE INVENTION

1. Field of the Invention

The invention concerns a piston pump for thick matter with at least a hydraulic operated pump cylinder, of which the pump piston is connected to the piston of a hydraulic drive cylinder by a common piston rod, and with a water box situated between the pump cylinder and the drive cylinder, through which the piston rod passes and which has a service opening at the top and accessible from above and a water outlet nozzle located at the bottom end.

2. Description of the Related Art

Piston pumps of this type are employed for transporting thick matter such as concrete, sewage sludge, excavated tunnel material and like. The water box is associated above all with a cleaning function: the common piston rod extending through the water box is freed or kept free of impurities from the area of the pump cylinder, in order to prevent contamination of the hydraulic fluids. In addition, the water box is associated with an important assembly and maintenance function: the pumping pistons which are exposed to a more or less greater abrasion, depending upon the abrasives of the media being conveyed, must be changed out at predetermined time intervals. They are thus releasably connected to the piston rod. The assembly occurs within the water box through the service opening at the top end. As inherently necessary for construction, the water box is located in the central area of a movable or stationary pump base, in which also other elements or aggregates of the pump assembly are located. The space available above the water box is thus most often very narrow, so that the access opening and the inside of the water box are only accessible from the outside with difficulty. The assembly of the pumping piston is further complicated thereby, that the pumping piston which is to be positioned in a defined mounting position has a high weight and the fasteners, such as screws and nuts, are to be assembled at positions not visible from the outside. It occasionally happens that during the assembly process a screw or a nut falls to the bottom of the water box and must be search for blindly and with great difficulty.

SUMMARY OF THE INVENTION

Beginning therewith, the invention is concerned with the task of improving the known piston pumps of the above-described type in such a manner, that a simplification of piston assembly and maintenance becomes possible.

The inventive solution is based on the concept, that the assembly of the piston can be greatly simplified by providing a two-sided access to the water box. In order to achieve this, it is proposed in accordance with the invention that the water box is provided at its bottom side with a removable floor plate forming an access opening which can be closed to form a fluid-tight seal.

In order to accommodate without twist or torsion the forces occurring in the water box during pumping, it is proposed, in accordance with a preferred embodiment of the invention, that the floor-sided service opening is bordered by a circumscribing, downwards-directed flange, on which the floor plate is secured fluid-tight. A further improvement in this respect can be achieved thereby, that the floor plate form-fittingly engages in an edge-open recess of the water box. For this the floor plate preferably exhibits an appropriate circumscribing edge which engages form-fittingly in a complementary flange recess or rib. Between the flange and the floor plate an appropriate circumscribing sealing ring is introduced for improved sealing.

A further advantageous design of the invention takes into consideration that an outlet pipe is provided on the floor plate and extending beyond the outer, downwards-facing broadside surface thereof. It is advantageously attached centrally in the floor plate via a 90°-bent pipe and with its free end is essentially parallel to the broadside surface and extending towards outside beyond one of the side edges of the floor plate, so that it can be releasably hung on to a preferably hook-shaped holder which is fixed to the base. When the water box is further provided with an angled holder, which engages below the floor plate in the area of the edge lying opposite to the holder device, then after emptying of the water box the floor plate can be separated from the flange, without having to be manually held. Then for removal of the floor plate and for exposing the bottom side service opening it is only necessary that the outlet pipe is lifted out of the hook-shaped holder and the floor plate is pulled out of the angled holder. In order to simplify this, the floor plate is provided with a handgrip which projects from its outer broad surface.

For further simplification of the piston assembly, an assembly aide for alignment within the water box of the pumping piston to be assembled relative to the piston rod can be provided which can be introduced into the water box through the top service opening. In order that the assembly can be carried out by a single service person, it is of advantage, when the assembly aide can temporarily be held on the water box, preferably in the area of the edge of the upper service opening, wherein the assembly aide is formed for example as a belt or strap securable on the edge of the water box, extending into the water box and engaging the pumping piston from below.

BRIEF DESCRIPTION OF THE DRAWINGS

In the following the invention will be described in greater detail on the basis of the embodiment which is represented in schematic manner in the figures. There is shown FIG. 1 a two-cylinder piston pump for thick matter in perspective representation.

DETAILED DESCRIPTION OF THE INVENTION

Figure 1:
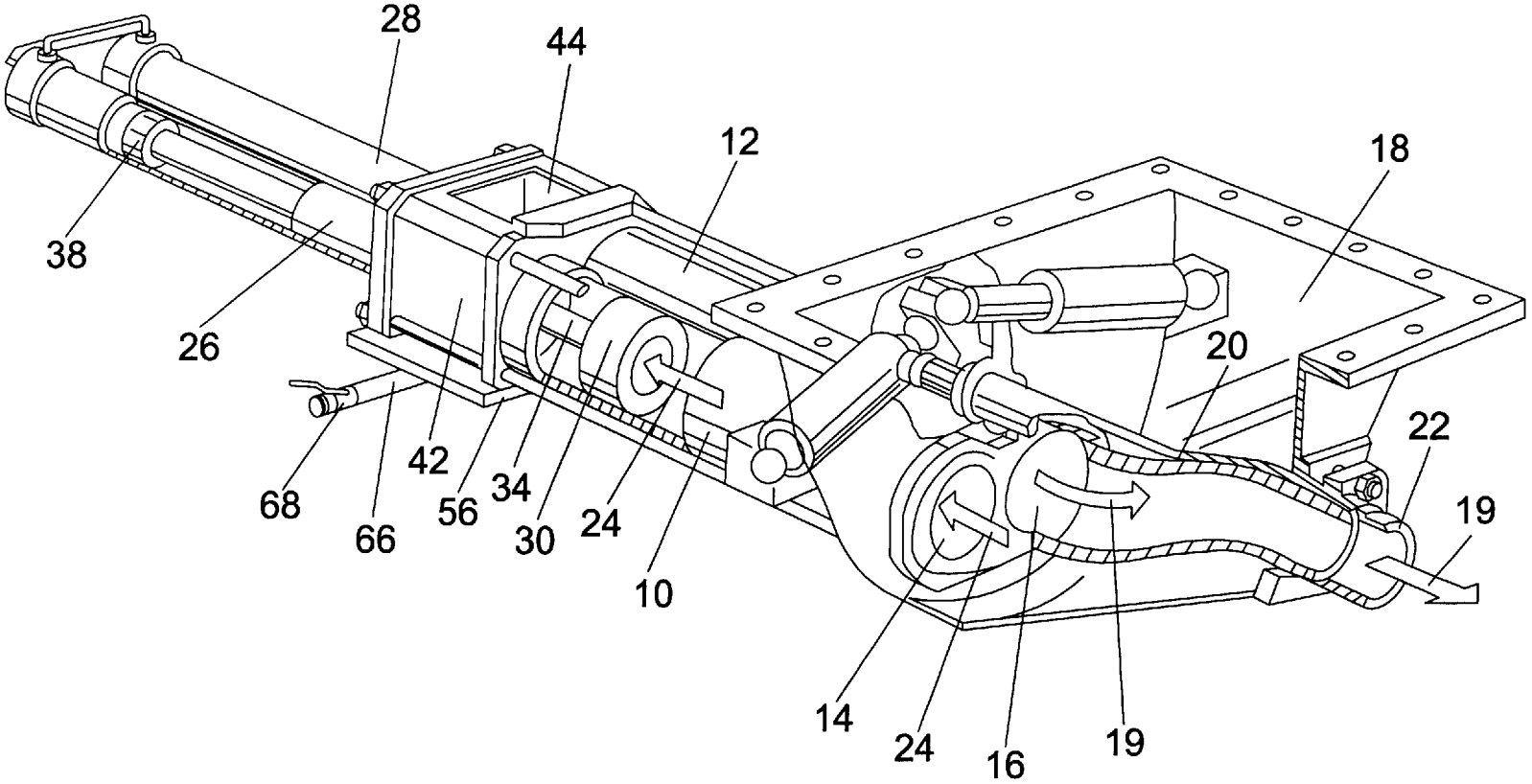

The thick matter pump shown in the drawings is comprised essentially of two pumping cylinders 10, 12, of which the end openings 14, 16 open into a material supply container 18 and are alternately in communication with a conveyance conduit 22 during the pressure stroke (arrow 19) via a pipe siding 20 and then open with respect to the material supply container 18 during a suction stroke (arrow 24) with intake of material. The pump cylinders 10, 12 are driven via hydraulic drive cylinders 26, 28 are driven in counter-stroke or opposing manner. For this purpose the pumping pistons 30 are connected with the piston 38 of the drive cylinder 26, 28 respectively via a common piston rod 34. In the central area between the pumping cylinders 10, 12 and the drive cylinders 26, 28 there is a water box 42, through which the piston rods 34 extend. In the water box there is introduced, via the lid side service opening 44, for each of the pumping pistons 30 respectively an associated, not shown, abutment or stop body which prevents that during operation the pumping piston and the material suctioned by it during operation enter into the water box. The abutment or stop bodies can be removed from the water box through the service opening 44, so that the pumping pistons 30 can be displaced in the water box for repair and service operations. The pumping pistons are secured to the piston rod with multiple screws. These screws must be removed or inserted within the water box. Since the water box 42 is provided in the central area of the thick material pump on a movable or stationary pump base 46, in which for engineering construction reasons additional assemblies or units 48 are provided, such as a pump motor or an oil basin, there remains above the assembly opening 44 only a small amount of free space 50 for the carrying out of the assembly operation.

Figure 2:
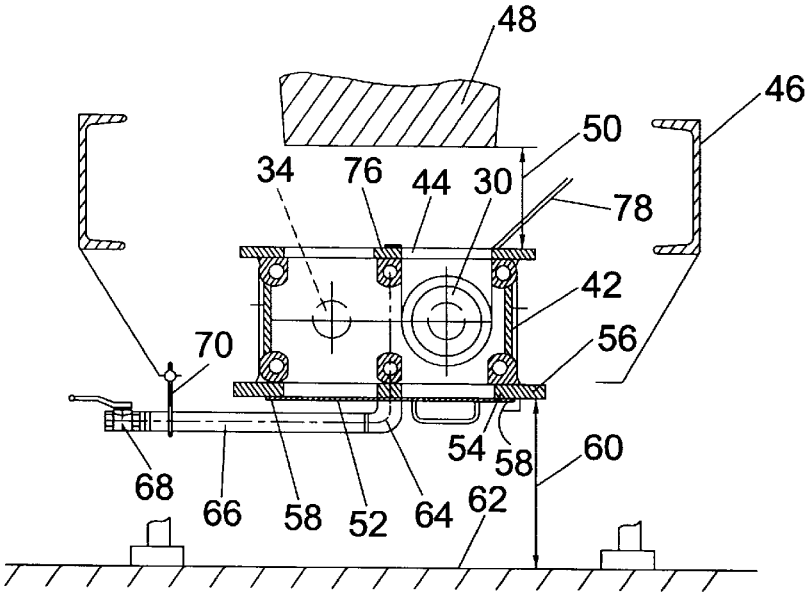
FIG. 2 a section through the pump assembly in the area of the water box.
Figure 3A:
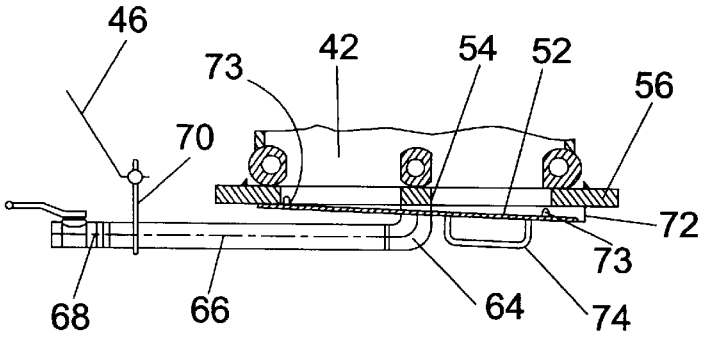
FIG. 3*a* a sectional representation of the floor area of the water box according to FIG. 2 during releasing of the floor plate.
Figure 3B:
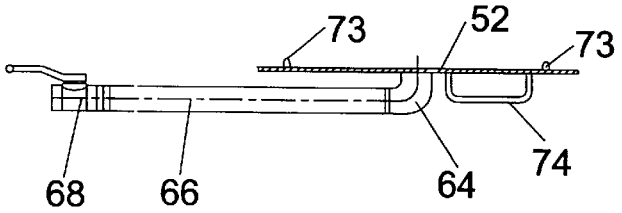
FIG. 3*b* a sectional representation of the floor plate removed from the water box.

In order to facilitate the assembly operation, the water box 42 is additionally provided on bottom side in the illustrated embodiment with a removable assembly opening 54 which is closeable fluid-tight by a removable floor plate 52, which is bordered by a circumscribing, downwards directed flange 56, onto which the floor plate 52 is securable by means of screws 58 in a fluid-tight manner by clamping there-between a not shown circumscribing sealing ring. Thereby the free space 60 between the ground surface 62 of the pump base 60 [sic] and the bottom side assembly opening 54 can be used for service such as assembly purposes. For improving the form stability, the floor plate 52 can be provided with a not shown circumscribing rib or edge, with which it is form fittingly introducable into the floor side assembly opening 54. A water outlet pipe 66 is connected to the bottom side of the floor plate via a 90°-bent pipe 64, which with its free end, which is provided with a valve means 68, extends beyond the outer edge of the water box 42 and there can be hung from a hook-shaped supporting means 70 which is fixed to the base. On the edge of the flange 56 lying opposite to the hook support means 70 there is at least one angle iron 72 which engages underneath the associated side edge of the floor plate 52, which ensures together with the hook-shaped holder means 70 therefore, that the floor plate 52 during removal of the screws 58 is held in an intermediate position and does not fall down. When all screws 58 are removed the floor plate 52 can be gripped by the handgrip 74 and be removed from the holder angle iron 72 and the holder means 70 (compare FIGS. 3*a* and *b*). Thereby the water box is accessible both via the lid side access opening 44 as well also via the floor side access opening 54. By use of a assembly aide 8, which in the case of FIG. 2 is shown as a belt or strap 78 of which one and is fastened to a central beam 76, the pumping piston 30 to be assembled or disassembled can be positioned from above in the correct assembly position adjacent the piston rod 34, while the manipulation of the fasteners can occur from the floor side access opening unimpeded.

In summary the following is to be concluded: the invention concerns a piston pump for thick matter such as concrete, sewage sludge, excavated tunnel material and the like. The inventive piston pump has at least one hydraulically operated pump cylinder 10, 12. The pump piston 30 of said pump cylinder 10, 12 is connected to the piston 38 of a hydraulic drive cylinder 26, 28 by a common piston rod 34. Between the pump cylinders 10, 12 and the drive cylinders 26, 28 a water box 42 is provided through which the piston rod 34 passes for cleaning purposes, and which has an access opening 44 at the top end, said opening being accessible from above, and a closeable water outlet nozzle 66 located at the bottom end. For service access the water box 42 also has an access opening 54 located at the bottom end for easier assembly which can be closed in a liquid-tight manner by means of a removable base plate 52.

What is claimed is:

1. Piston pump for thick matter including:

at least one hydraulic operated pump cylinder (10, 12) having a pump piston (30);

at least one hydraulic drive cylinder (26, 28) having a drive piston (38);

at least one common piston rod (34) connecting said pump piston (30) to said drive piston (38);

a water box (42) having a top side and a floor side, said water box situated between said pump cylinder (10, 12) and said drive cylinder (26, 28), said piston rod (34) passing through said water box, said water box having an access opening at the top side (44) accessible from above and an access opening at the floor side (54) accessible from below, said water box further including a removable floor plate (52) closing said floor side access opening (54) in a fluid-tight manner, and said water box including a water outlet pipe (66) located at the floor side.

2. Piston pump according to claim 1, wherein the floor-sided access opening (54) is bordered by a circumscribing flange (56) against which the floor plate can be secured in a fluid-tight manner.

3. Piston pump according to claim 2, wherein a sealing ring is located between the flange (56) and the floor plate (52).

4. Piston pump according to claim 1, wherein that floor plate (52) form fittingly engages in an edge-open recess of the water box (42).

5. Piston pump according to claim 4, wherein said floor plate is provided with a recess or rib which fits form-fittingly in a complementary flange.

6. Piston pump according to claim 5, wherein said recess or rib circumscribes said floor plate.

7. Piston pump according to claim 1, wherein said outlet pipe (66) extends through said floor plate (52) and projects beyond the edge of floor plate (52) outer downwards-facing broadside.

8. Piston pump according to claim 7, wherein said water box is provided on a base, wherein a hook-shaped holder is attached to said water box or said base, and wherein said outlet pipe (66) extends essentially parallel to the broadside surface of the floor plate (52) with outlet pipe (66) having a free end projecting beyond one of the side edges of the floor plate, and wherein said outlet pipe is releasably hung on said hook-shaped holder means (70).

9. Piston pump according to claim 1, wherein the outlet pipe (66) is attached via a 90°-bent pipe centrally in the floor plate.

10. Piston pump according to claim 1, wherein a holder angle-iron (52) situated on the water box which engages from below the floor plate (52) in the area of one of its edges.

11. Piston pump according to claim 1, wherein the holder angle-iron (72) is situated on the edge of the floor-sided assembly opening (54) which lies opposite to the hook-shaped holder device (70).

12. Piston pump according to claim 1, wherein the floor plate (52) is provided with a handgrip (74) extending from its outwardly facing broadside surface.

13. Piston pump according to claim 1, wherein an assembly aide (78), which can be introduced into the water box (42) via the lid sided access opening (44), for positioning the pump piston (30) inside the water box (42) relative to the piston rod (34).

14. Piston pump according to claim 12 or 13, characterized in that the assembling element (78) is formed as a belt which can be secured to the water box (42), and which loops under the pump piston (30) within the water box.

15. Piston pump according to claim 13, wherein the assembling aide (78) can be secured to the water box (42).

16. Piston pump according to claim 15, wherein said assembling aide (78) can be secured to the water box (42) in the edge area of the lid-sided assembly opening (44).

* * * * *